United States Patent [19]

Willis

[11] Patent Number: 4,673,202

[45] Date of Patent: Jun. 16, 1987

[54] DOOR LOCKING DEVICE

[76] Inventor: David P. Willis, 4400 Memorial #3047, Houston, Tex. 77077

[21] Appl. No.: 776,571

[22] Filed: Sep. 16, 1985

Related U.S. Application Data

[63] Continuation of Ser. No. 346,196, Feb. 5, 1982, abandoned.

[51] Int. Cl.[4] ..... E05C 1/16

[52] U.S. Cl. ..... 292/162; 292/150; 292/264

[58] Field of Search ..... 292/162, 32, 42, 150, 292/145, 148; 70/416, 118, 120, 417, 211, DIG. 58, DIG. 63

[56] References Cited

U.S. PATENT DOCUMENTS

| | | | |
|---|---|---|---|
| 258,833 | 5/1882 | White . | |
| 307,796 | 11/1884 | Peterson . | |
| 429,510 | 6/1890 | Davy et al. . | |
| 756,064 | 3/1909 | Sherman . | |
| 955,774 | 4/1910 | Drury | 292/150 X |
| 1,055,510 | 3/1913 | Birkle, Jr. . | |
| 1,508,091 | 9/1924 | Diesel . | |
| 1,572,077 | 2/1926 | Perez | 292/169.14 |
| 1,700,135 | 7/1927 | Lanes . | |
| 1,705,667 | 3/1929 | Heath . | |
| 1,894,913 | 1/1933 | Sadler | 292/340 X |
| 1,956,388 | 4/1934 | Kalina | 292/150 X |
| 2,463,195 | 3/1949 | Mungan . | |
| 2,611,933 | 9/1952 | Comfort | 292/162 X |
| 3,263,462 | 3/1964 | Suroff et al. . | |
| 3,391,956 | 7/1968 | Rolfe, Jr. . | |
| 3,414,306 | 12/1968 | Bernstein | 70/416 |
| 3,423,974 | 1/1969 | Bernsley . | |
| 3,484,127 | 12/1969 | Pastva . | |
| 3,585,827 | 6/1971 | Dominguez . | |
| 3,724,246 | 4/1973 | Katsaros . | |
| 3,748,882 | 7/1973 | Dusault, Jr. et al. . | |
| 3,773,369 | 11/1973 | Wersonick . | |
| 3,815,390 | 6/1974 | Stoia | 292/150 X |
| 3,826,117 | 7/1974 | Racobs . | |
| 3,826,556 | 1/1975 | Moses . | |
| 3,921,423 | 11/1975 | Hollins . | |
| 3,927,544 | 12/1975 | Klein . | |
| 3,933,014 | 1/1976 | Moses . | |
| 3,937,503 | 2/1976 | Harris . | |
| 4,064,721 | 12/1977 | Morgan . | |
| 4,109,949 | 8/1978 | Smith . | |
| 4,113,291 | 9/1978 | Cameron | 70/DIG. 63 X |
| 4,127,967 | 12/1978 | Franzl . | |
| 4,152,911 | 5/1979 | Sharma . | |
| 4,159,838 | 7/1979 | Wilzig et al. . | |
| 4,185,483 | 1/1980 | Lupton et al. . | |
| 4,279,137 | 7/1981 | Cook | 70/416 |
| 4,482,177 | 11/1984 | Nagy | 292/150 X |

FOREIGN PATENT DOCUMENTS

| | | | |
|---|---|---|---|
| 532415 | 11/1921 | France | 292/145 |
| 928473 | 11/1947 | France | 70/416 |
| 124009 | 2/1949 | Sweden | 292/162 |
| 9888 | 7/1887 | United Kingdom | 292/145 |
| 181933 | 6/1922 | United Kingdom | 292/150 |
| 354590 | 8/1931 | United Kingdom | 70/416 |

*Primary Examiner*—Richard E. Moore
*Attorney, Agent, or Firm*—Gunn, Lee & Jackson

[57] ABSTRACT

A door locking device is provided for securing a door with a dead bolt having a thumb knob on the inside of the door for throwing a dead bolt into a striker plate with the door jamb. The door locking device has a support body attached to the inside of the door, a dead bolt slide slidably engaged with the support body, and a keeper attached to the door jamb with at least one keeper hole lying in a plane substantially perpendicular to the plane of the door in the closed position. The dead bolt slide provides a second dead bolt locking function by engaging the keeper while simultaneously rendering the dead bolt lock within the door unopenable with a restriction means that restricts rotation of the thumb knob from its locked position.

11 Claims, 9 Drawing Figures

Fig. 1
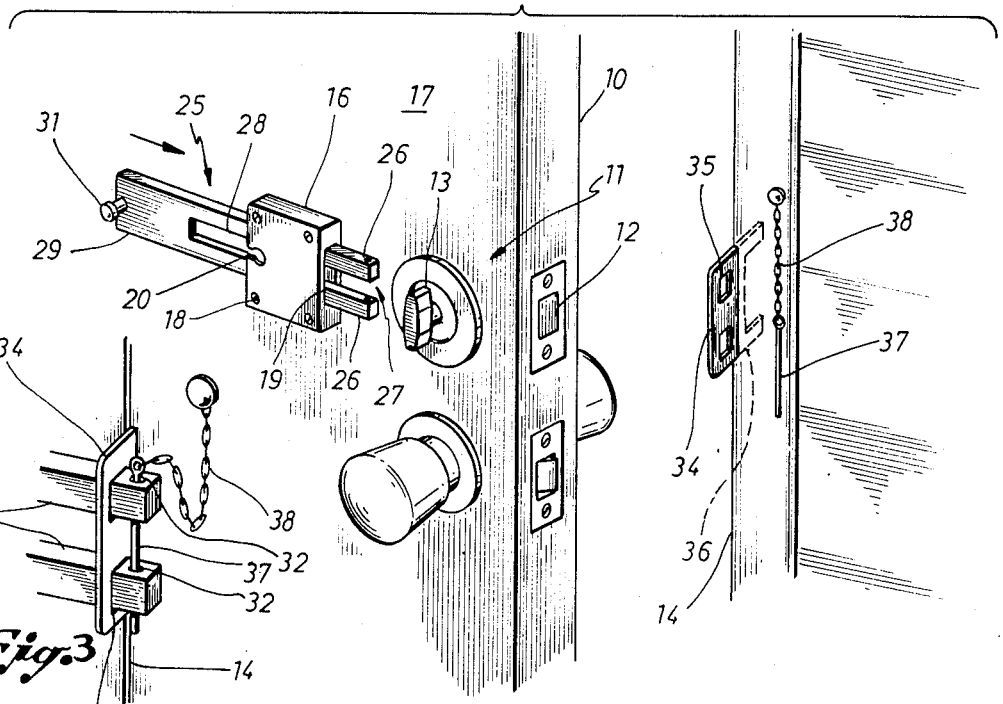
Fig. 3
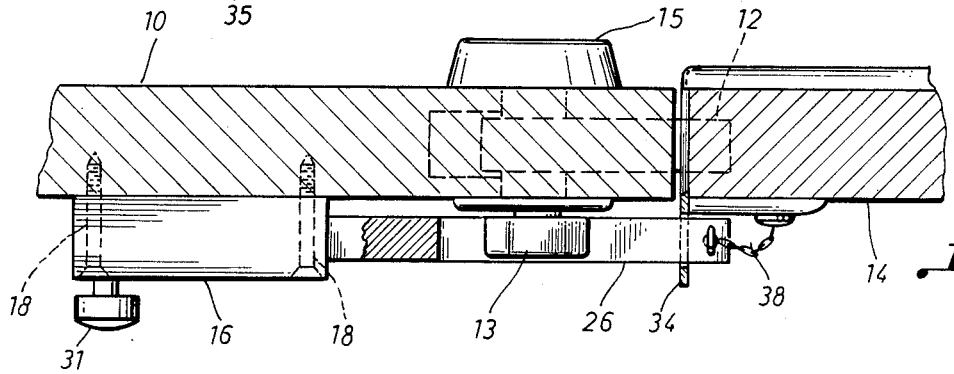
Fig. 2
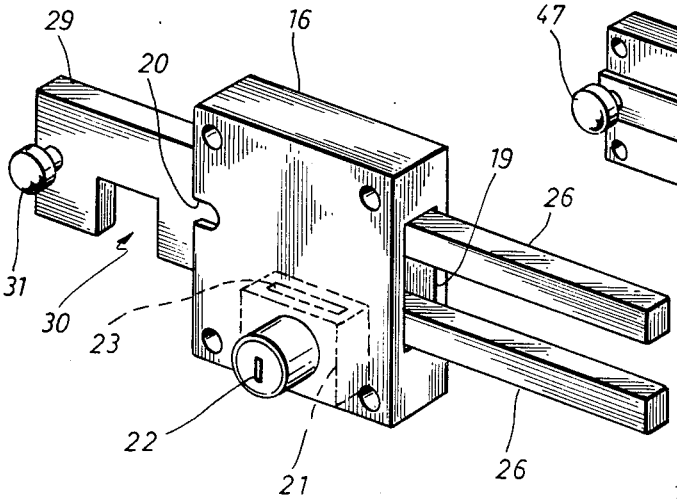
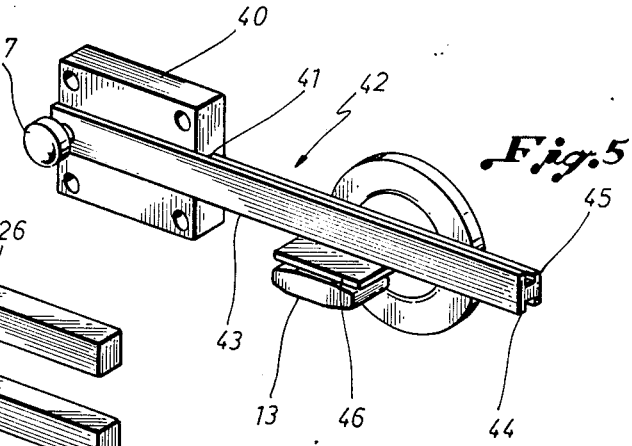
Fig. 5
Fig. 4

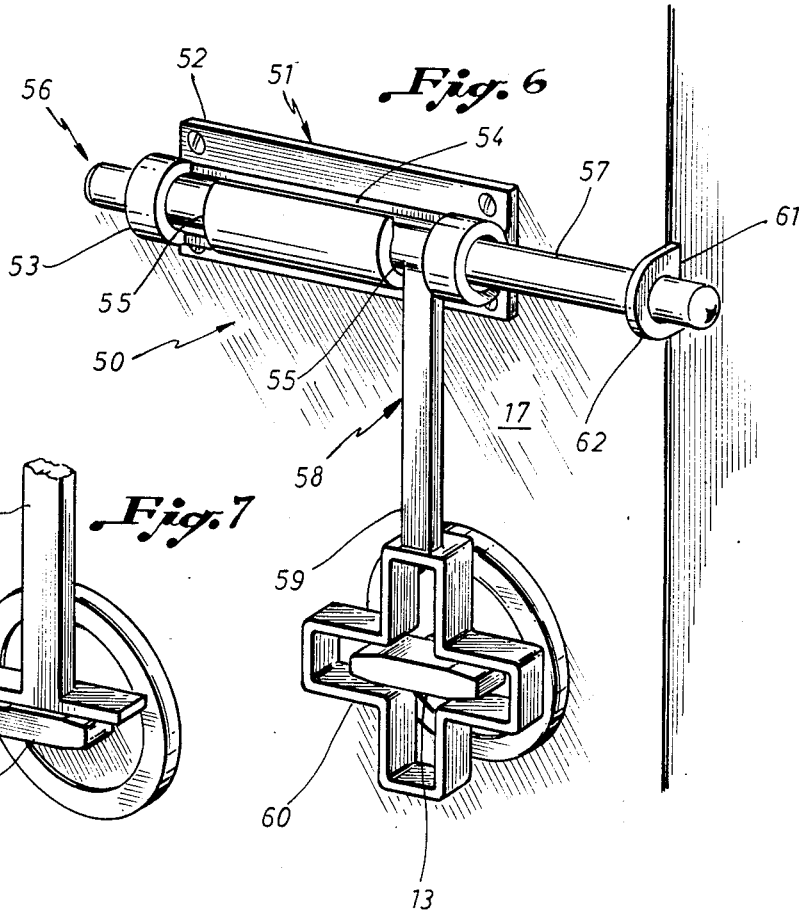
Fig. 6
56
52
51
54
57
61
53
55
50
55
17
62
58
59
13
60
13
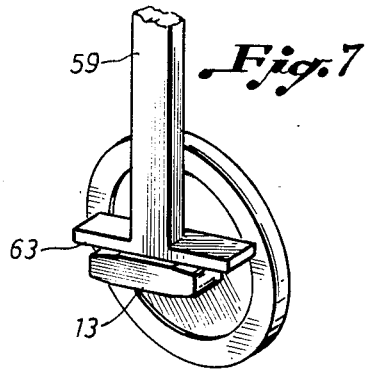
Fig. 7
59
63
13
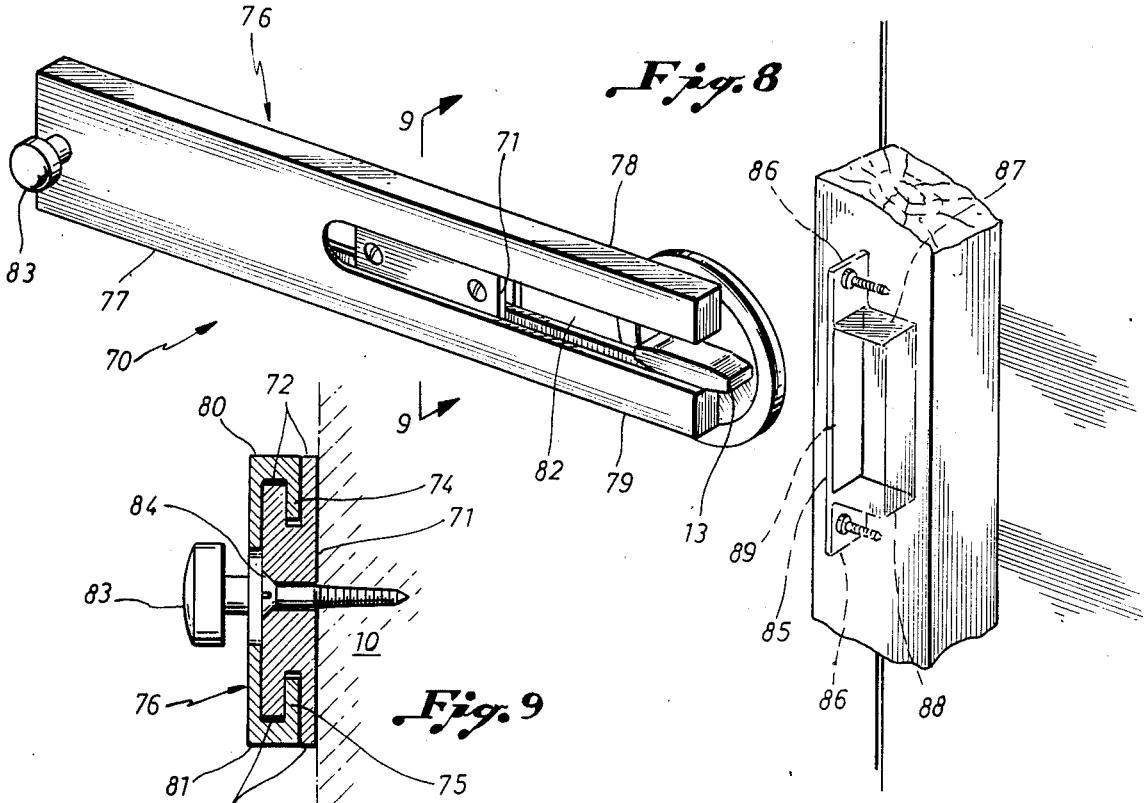
Fig. 8
76
9
71
78
86
87
83
77
70
82
79
13
89
85
86
88
Fig. 9
80
72
9
74
84
71
83
10
76
81
73
75

DOOR LOCKING DEVICE

This is a continuation of application Ser. No. 06/346,196 filed Feb. 5, 1982, now abandoned.

BACKGROUND OF THE INVENTION

This invention relates generally to a novel device for use in locking a door from the inside. More particularly, this invention concerns a novel door locking device that provides supplemental locking functions that enhance the security furnished by conventional dead bolt locking assemblies that are activated from the inside by rotation of a thumb knob or the like.

Concern and fear over rising crime rates have recently focused increased attention on improving residential security. Of particular concern has been the increased incidence of crimes involving the breaking and entering of residential properties. For many years, various attempts have been made to provide an adequate and dependable means of locking the doors of residences so as to stop or discourage substantially unauthorized entry.

One of the most commonplace locking devices used for both residential and commercial properties is the dead bolt lock wherein a dead bolt held within the door is thrown into a striker place held within the door jamb. The typical dead bolt locking assembly used for residential doors has a key activated mechanism for opening and closing the lock from the outside and a thumb knob or a similar piece for opening and closing the lock from the inside by rotation of the thumb knob. Typically, the key activated mechanism and the thumb knob are integrally attached to the tumblers of the dead bolt mechanism so that any movement of a key to open or close the lock from the outside necessarily causes and requires movement of the thumb knob to the opened or closed position as the case may be.

When used alone, these conventional dead bolt locking mechanisms suffer from a number of disadvantages. Because they are designed for key-activated entry, such dead bolt locking mechanisms are subject to picking from the outside. In addition, anyone with a key cut to fit the dead bolt mechanism, whether a key for the specific lock involved or a master key, will be able to unlock the dead bolt locking mechanism whether or not the persons inside the residence desire the entry of the person having such key.

There have been a number of attempts in the prior art to provide additional locking security in connection with various dead bolt locking mechanisms. One such attempt is that described by White in U.S. Pat. No. 258,883. White discloses a dead bolt lock with its essential parts contained completely on the inside face of the door and door jamb, rather than within the door body and door jamb body. White attempts to provide an additional measure of security through preventing the key lock from being turned by means inserted into the keyhole from the outside. This is accomplished by adding an additional member to the dead bolt lock, which member is inserted into a key placed in the door keyhole from the inside. White's combined bolt and key fastener suffers from a number of distinct disadvantages. First, the secondary locking function depends both on the presence of a key inserted into the keyhole from the inside and on the engagement of that key by a member attached to the dead bolt lock. Further, activation of White's dead bolt lock does not accomplish activation of his secondary locking means but instead requires a second motion to achieve the additional locking function.

Another attempt at providing increased security from a dead bolt lock is that suggested by Lanes in U.S. Pat. No. 1,700,135. Lanes describes a means of simultaneously preventing the unlocking of a dead bolt lock with a thumb knob while providing an auxiliary pivot bolt lock. The use of any of the embodiments of Lanes requires the additional step of rotation of the auxiliary bolting lock to its locked position following activation of the basic dead bolt lock itself. Thus, to the extent that Lanes describes two locking functions, such functions cannot be activated simultaneously by one single motion.

Another type of attempt in the prior art at achieving additional security from dead bolt locks is exemplified by that described in U.S. Pat. No. 3,927,544 to Klein. An unhinged hasp device is disclosed by Klein for preventing the turning of a thumb knob of a dead bolt lock. It is clear, however, that Klein simply provides a slotted bar that can be slipped over a dead bolt thumb knob but which does not provide any auxiliary dead bolt locking function.

The most recent attempt at preventing keyed entry through a door having a conventional thumb knob dead bolt lock is that disclosed by Lupton et al in U.S. Pat. No. 4,185,483. Lupton describes a door locking device comprising a wedge of rubber placed between the door handle stem and the thumb knob of the dead bolt lock. The wedge of Lupton, however, provides no auxiliary dead bolt locking function.

SUMMARY OF THE INVENTION

The present invention provides a novel door locking device that minimizes or reduces the deficiencies and disadvantages in the prior art door locking devices of the type previously noted. According to the invention, a door locking device is provided for enhancing the security and locking function provided by a conventional dead bolt locking mechanism. The door locking device of the present invention provides a number of beneficial results and advantages in its use. In particular, the present door locking device enhances the security provided by a dead bolt lock mechanism without requiring modification of the dead bolt lock mechanism itself by making use of the configuration of typical dead bolt locks. The advantages in the use of the present door locking device include ease of manufacture and installation. Further, the present door locking device is equally applicable to inwardly and outwardly opening doors.

In summary, the present invention provides an improved door locking device useful for securing a door with a conventional dead bolt lock within the body of the door. In such conventional dead bolt locks, there is provided a thumb knob on the inside of the door for throwing a dead bolt into and out of a striker plate within the jamb of the door. The door locking device comprises three basic parts: a support body, a dead bolt slide, and a keeper. The support body is attached to the inside face of the door, and the dead bolt slide is supported by and slidably engaged with the support body. The keeper is attached to the door jamb and has at least one keeper hole lying in a plane that is substantially perpendicular to the plane of the door in the closed position. The support body, dead bolt slide, and keeper are arranged with respect to each other so that the dead bolt slide is capable of providing a second dead bolt locking function by engagement of at least one bolt portion thereof with the keeper, while simultaneously rendering unopenable the dead bolt lock within the body of the door. The conventional dead bolt lock is made tamper proof or unopenable by engagement of an restriction means of the dead bolt slide with a thumb knob so as to restrict its rotation from the locked position.

The restriction means of the dead bolt slide may take a number of forms. One of those comprise a longitudinal slot formed by two substantially parallel bolt portions. The width of the longitudinal slot is slightly greater than the thickness of the thumb knob so that there is one bolt portion engaging the top of the thumb knob and another bolt portion engaging the bottom. When the restriction means takes this form, the keeper may have two holes for receiving the two substantially parallel bolt portions or the keeper may have one hole sized so that the top of the upper bolt portion and the bottom of the lower bolt portion fit snugly therein. In either case, the keeper may advantageously be a supplemental striker plate attached to and extending from the door jamb in the direction that is substantially perpendicular to the plane of the door in the closed position.

The dead bolt slide may take a number of forms in order to provide the restriction means comprising a longitudinal slot. One such form is a continuous piece of uniform thickness having a base portion from which the two substantially parallel base portions emanate. To accommodate this form of the dead bolt slide, the support body has two identical holes and the thickness of the dead bolt slide is less than the width of the two identical holes in the support body through which the dead bolt slide passes and by which the dead bolt slide is engaged.

Where the dead bolt slide takes the form having a base portion with two substantially parallel portions emanating therefrom, the door locking device of the present invention can comprise additional valuable features. For instance, the support body can contain a locking means for securing the dead bolt slide relative to the support body when the two bolt portions are in place within the holes of the keeper. In such a case, the base portion of the dead bolt slide has a locking slot therein for receiving an auxiliary dead bolt from the locking means within the support body.

In another distinct embodiment of the door locking device of the present invention, the support body comprises a solid piece with an engaging slot running its full length. The engaging slot has an interior width greater than its exterior width so that it is capable of retaining a dead bolt slide comprising a single flanged bolt portion with a top flange fitting flush against the face of the support body and a bottom flange fitting integrally within the engaging slot.

In the embodiment of the door locking device wherein the dead bolt slide comprises a single flange bolt portion, the engagement means may comprise an antirotation plate attached substantially perpendicularly to the top flange of the bolt portion. The antirotation plate is located along the length of the bolt portion so that it engages the thumb knob in its closed position when the bolt portion is engaged in the keeper.

With any embodiment having a supplemental striker plate as a keeper, the door locking device may further comprise a striker plate locking means for securing the dead bolt slide relative to the supplemental striker plate. Such striker plate locking means may, for instance, comprise a locking hole located at the striker plate end of each bolt portion and a single locking pin for insertion into such locking holes.

Examples of the more important features of this invention have been summarized broadly in order that the detailed description thereof that follows may be better understood. There are, of course, additional features of the invention that will be described hereinafter and which will also form the subject matter of the claims appended hereto.

BRIEF DESCRIPTION OF THE DRAWINGS

FIG. 1 is a perspective view of a preferred embodiment of the door locking device of the present invention, as it would appear installed on a conventional residential door and accompanying door jamb.

FIG. is 2 a partially cutaway plan view of the embodiment of the invention shown in FIG. 1, depicted in the closed and locked position.

FIG. 3 is a partially cutaway perspective view showing the detail of the striker plate locking means of a preferred embodiment of the invention, in the closed and locked position.

FIG. 4 is a perspective view of a preferred embodiment of the invention, depicting a locking means for securing the dead bolt slide relative to the support body.

FIG. 5 is a perspective view of an alternate embodiment of the present invention.

FIG. 6 is a perspective view of yet another alternate embodiment of the present invention, as it would appear installed on a conventional residential door an accompanying door jamb in the closed and locked position.

FIG. 7 is a perspective view of an alternate embodiment of the restriction means of the dead bolt slide of the embodiment of FIG. 6.

FIG. 8 is a perspective view of a further alternate embodiment of the present invention wherein the support body is recessed within the dead bolt slide. This Figure also illustrates an alternate embodiment of the keeper of the door locking device of the present invention.

FIG. 9 is a cross-sectional view taken along line 9—9 of FIG. 8, depicting in detail the recessed nature of the support body of the embodiment of FIG. 8.

Like reference numerals have been applied to like elements in each of the various drawings.

DETAILED DESCRIPTION OF THE PREFERRED EMBODIMENTS

Referring to the drawings, in particular FIGS. 1 and 2, there is shown a door locking device of the present invention installed in connection with door 10 and door jamb 14. A door 10 is equipped with a convention dead bolt lock 11 which comprises thumb knob 13 for throwing dead bolt 12 into and out of a striker plate (not shown) within the door jamb 14. As indicated in FIG. 2, the dead bolt lock includes a dead bolt keyhole piece 15 located on the outside face of the door. Keyhole piece 15 comprises a key activated mechanism for opening and closing the lock from the outside. For the conventional dead bolt lock mechanism, the key activated mechanism and thumb knob 13 are integrally attached to the tumblers of the dead bolt mechanism. Thus, any movement of a key to open or close the lock from the outside necessarily causes and requires movement of thumb knob 13 to the opened or closed position, respectively. The present invention takes advantage of this feature of the conventional dead bolt lock mechanism described above and works equally well for inwardly and outwardly opening doors and equally well in protecting against entry by use of any key including a master or by attempts to pick the dead bolt lock.

The three basic components of the embodiment of the door locking device of the present invention depicted in FIGS. 1 and 2 are a support body 16, a dead bolt slide 25, and a keeper in the form of supplemental striker plate 34. The support body 16 is mounted on inside face 17 of door 10 by means such as screws 18. Support body 16 must be mounted in a location on inside face 17 to provide for proper engagement between restriction means 27 of the dead bolt slide 25 and thumb knob 13 of the conventional dead bolt lock 11.

In the preferred embodiment depicted in FIGS. 1 and 2, the support body has a support body hole 19 running parallel to the horizontal. Dead bolt slide 25 is constructed of a continuous piece of uniform thickness less than the smaller dimension of the support body hole 19 so that dead bolt slide 25 is free to slide back and forth through but is retained by support body hole 19. The dead bolt slide 25 includes a base portion 29. From this base portion 29, two substantially parallel bolt portions 26 emanate so as to form a restriction means 27 in the form of longitudinal slot 28.

When door 10 is closed and dead bolt lock 13 is in the closed position, thumb knob 13 runs substantially parallel to the horizontal. Thus, when dead bolt slide 25 is, with sliding motion, moved toward the door jamb 14, longitudinal slot 28 engages thumb knob 13 so that one of the bolt portions 26 engages the top of thumb knob 13 and the other one of the bolt portions 26 engages the bottom of thumb knob 13. This engagement restricts any rotation of thumb knob 13 so that dead bolt lock 11 cannot be opened from the outside with any type of key or picking tool.

Supplemental striker plate 34 is mounted in or onto door jamb 14 in a position so that engagement can be achieved between bolt portions 26 of dead bolt slide 25 and striker plate holes 35 of the supplemental striker plate 34. The supplemental striker plate 34 is mounted into or onto door jamb 14 using mounting base 36. Supplemental striker plate 34 extends from door jamb 14 in a direction substantially perpendicular to the plane of the door 10 in the closed position as indicated clearly in FIG. 2. The striker plate holes 35 are made to engage closely the bolt portions 26 of dead bolt slide 25, as shown in detail in FIG. 3.

The engagement between the striker plate holes 35 and the ends of bolt portions 26 provides an additional dead bolt locking function beyond that provided by the dead bolt lock 11. It is a principal feature and advantage of the door locking device of the present invention that this additional dead bolt locking function is accomplished simultaneously with the securing of dead bolt lock 11 by one single horizontal sliding motion of dead bolt slide 25.

The additional dead bolt locking function provided by engagement between the striker plate holes 35 and the ends of bolt portions 26 in the embodiment depicted in FIG. 1 can be provided in a number of other ways. For example, in place of supplemental striker plate 34 of FIG. 1, there could be substituted a keeper of the type shown in FIG. 8 as keeper 85. Keeper 85 is mounted within the door jamb itself in contrast to supplemental striker plate 34 of FIG. 1 which extends from the door jamb in a direction perpendicular to the plane of the door in the closed position. Keeper 85 is mounted within the door jamb by use of mounting extensions 86 for receiving mounting screws therein. A single rectangular keeper hole 89 is provided by keeper 85 for receiving the parallel bolt portions of the dead bolt slide. If keeper 85 were substituted for supplemental striker plate 34 in a door/door jamb configuration suitable for housing keeper 85, the top portion of the upper parallel bolt portion 26 and the bottom of lower parallel bolt portion 26 would respectively fit snuggly against the upper plate 87 of the keeper and the lower plate 88 of the keeper.

The preferred embodiment of dead bolt slide 25 and support body 16 as depicted in FIG. 1 may comprise additional preferred features. A number of such features are depicted best in FIG. 4. Base portion 29 of dead bolt slide 25 may include a stop knob 31 near its end furthest from the edge of door 10. If dead bolt slide 25 has such a stop knob 31, it is also preferable that support body 16 have a knob slot 20 for receiving stop knob 31 and preventing any further sliding motion of dead bolt slide 25 through support body 16. Stop knob 31 functions not only to prevent further sliding motion of dead bold slide 25 through support body 16 but also is useful as a handle in operating the door locking device of the present invention. It is to be understood that stop knob 31 and knob slot 20 are not necessary for the functioning of the present invention. It should also be understood that additional or other stops can be placed anywhere along base portion 29 to stop travel of the dead bolt slide 25 in the direction of the door jamb. In addition, other stops could be placed along either or both of bolt portions 26 so that horizontal sliding motion of dead bolt slide 25 in the direction away from door jamb 14 could also be stopped at an appropriate point, thus assuring that dead bolt slide 25 would always be retained within support body 16. Further, a barrel lock can be substituted for stop knob 31 so that an additional locking function between support body 16 and the dead bolt slide 25 can be achieved by the interaction of such barrel lock and knob slot 20.

Yet another advantageous feature that can be used in conjunction with the preferred embodiment depicted in FIG. 1 involves a further means of locking dead bolt slide 25 relative to support body 16 as shown in FIG. 4. There may be contained within support body 16 a locking means 21 for securing dead bolt slide 25 relative to support body 16 when the bolt portions 26 are in place within striker plate holes 19 or when there exists a need to lock the dead bolt slide 25 into any other position relative to the support body 16. This locking means 21 would preferably contain an auxiliary dead bolt 23 for insertion into a locking slot 30 located in base portion 29 of dead bolt slide 25. Locking means 21 can be activated by any conventional means, including a key activated mechanism 22 as shown in FIG. 4, in which case the mechanism could be used to prevent unauthorized exit as well as unauthorized entry. The locking means could also be activated by a conventional rotatable thumb knob.

There is depicted in FIG. 5 an alternate embodiment of the door locking device of the present invention. In this alternate embodiment, the support body 40 is a solid piece with an engaging slot 41 running its full length. Engaging slot 41 can be of any configuration sufficient to engage the dead bolt slide and retain it in place while allowing for horizontal sliding motion. Therefore, engaging slot 41 will preferably have an interior width greater than its exterior width.

The dead bolt slide 42 of the alternate embodiment comprises a single flange bolt portion 43. The flange bolt portion 43 has a top flange 44 that fits flush against the face of support body 40 and a bottom flange 45 that fits integrally with the engaging slot 41. A keeper suitable for receiving the end of flange bolt portion 43 would require only a single keeper hole. Engagement between flange bolt portion 43 and such a keeper would simultaneously achieve both the securing of the dead bolt lock 13 by prevention of rotation of thumb knob 13 and the providing of an additional dead bolt locking function by engagement between flange bolt portion 43 and the keeper.

As depicted in FIG. 5, this alternate embodiment may also include additional features. For instance, flanged bolt portion 43 may include a handle or knob 47 for ease in providing the horizontal sliding motion necessary to place the door locking device in the lock position. Further, the ability of the flange bolt portion 43 to restrict the rotation of thumb knob 13 may be enhanced by an antirotation plate 46 attached substantially perpendicular to top flange 44 at a location along the length of bolt portion 43 such that antirotation plate 46 engages thumb knob 13 in its closed position when the bolt portion 43 is engaged in a keeper.

Any of the embodiments of the door locking device described above may further comprise a striker plate locking means independent of the engagement means. Such a striker plate locking means would secure the dead bolt slide relative to the supplemental striker plate. This feature is most clearly depicted in FIG. 3. Such a striker plate locking means may comprise a locking hole 32 located at the striker plate end of each bolt portion 26. Each such locking hole 32 would preferably run substantially parallel to door jamb 14. The striker plate locking means would also include a single locking pin 37 for insertion into locking holes 32. Locking pin 37 can be mounted on door jamb 14 by means of locking pin chain 38.

FIGS. 8 and 9 show an embodiment of the door locking device of the present invention that is similar to that depicted in FIG. 1. The principal difference between the embodiment of FIG. 8 and that of FIG. 1 is the manner in which the dead bolt slide fits integrally with the support body. The door locking device 70 of FIG. 8 comprises support body 71, dead bolt slide 76, and keeper 85 mounted within the door jamb. It should be understood that, when the door jamb itself cannot accommodate the mounting of the keeper therein, keeper 85 could be mounted so as to extend from the door jamb in a direction substantially perpendicular to the plane of the door in the closed position. The support body 71 is in the form of a rectangular plate with a pair of upper horizontal flanges 72 and a pair of lower horizontal flanges 73 which form an upper horizontal groove 74 and a lower horizontal groove 75, respectively. The upper and lower horizontal grooves 74 and 75 are recessed within the upper and lower edges of the rectangular plate, as can best be seen in the detail of FIG. 9.

The dead bolt slide 76 comprises base portion 77 with an upper parallel bolt portion 78 and a lower parallel bolt portion 79 attached thereto. The base portion 77 has an upper and a lower L-shaped flange fitting integrally within the respective upper and lower horizontal grooves 74 and 75 of support body 71 so that the inside face of base portion 77 slides across the outside face of support body 71.

As shown in FIG. 8, the restriction means of dead bolt slide 76 comprises a longitudinal slot formed by the two substantially parallel bolt portions 78 and 79. As in the case of the embodiment of FIG. 1, the width of the longitudinal slot is slightly greater than the thickness of the thumb knob so that upper bolt portion 78 engages the top of the thumb knob and lower parallel bolt portion 79 engages the bottom of the thumb knob. The two parallel bolt portions 78 and 79 are respectively upper and lower substantially U-shaped pieces 80 and 81, as shown in FIG. 9. An L-shaped portion of each U-shaped piece 80 and 81 corresponds to and is attached to the respective upper and lower L-shaped flange of base portion 77 and likewise fits integrally within the respective upper and lower horizontal grooves 74 and 75 of support body 71. Base portion 77 of dead bolt slide 76 may also be provided with slide handle 83 for ease of movement of the dead bolt slide 76 into locking arrangement with thumb knob 13 and keeper 85. In place of slide handle 83, there could be provided a barrel lock with an appropriate receiving hole in support body 71.

Keeper 85 is depicted in FIG. 8 for a door/door jamb configuration such that the keeper can be installed within the door jamb and be in alignment with dead bolt slide 76. Keeper 85 has a single keeper hole 89 with an upper plate 87 and a lower plate 88 which engage respectively the upper parallel bolt portion 78 and the lower parallel bolt portion 79 of dead bolt slide 76.

FIG. 6 depicts yet another embodiment of the door locking device of the present invention. Door locking device 50 comprises support body 51, dead bolt slide 56 and keeper 61. The support body 51 includes a support body base 52 mounted on the inside face 17 of the door. Support body base 52 has a cylindrical slide support rigidly affixed thereto. The cylindrical slide support 53 has an activation slot for sliding the dead bolt slide 56 from the unlocked to the locked position in locking slots 55 to retain dead bolt slide 56 in the locked or unlocked position.

Dead bolt slide 56 comprises a bolt portion 57 for engaging keeper 61 in a restriction means 58. Restriction means 58 comprises a restriction means extension 59 substantially perpendicular to bolt portion 57. Attached to the end of the restriction means extension 59 is an entire rotation member 60, which restricts the rotation of thumb knob 13 when the door locking device 50 is in the locked position. Entire rotation member 60 is provided with both a horizontal and vertical slot for restricting movement of thumb knob 13. Thus, this particular embodiment could be used to secure a dead bolt lock where the thumb knob is horizontal or vertical in the locked position.

The operation of the dead bolt locking device 50 is, as with the other embodiments, a simple basic sliding motion. When in the unlocked position the restriction means extension 59 would be vertically extending through the locking slot 55 furthest from keeper 61. Restriction means 58 would then be rotated within that locking slot so that restriction means 58 could be slidably moved through activation slot 54 to the locking slot 55 nearest keeper 61, whereupon by the action of gravity upon extension means 58 restriction means extension 59 would rotate through the locking slot and allow the engagement between antirotation member 60 and thumb knob 13. This sliding motion will have simultaneously provided an additional dead bolt locking function by the insertion of bolt portion 57 of dead bolt slide 56 into keeper hole 62 of keeper 61. FIG. 7 depicts an alternate embodiment for the antirotation member. The elaborate antirotation member 60 with horizontal and vertical slots can be replaced by the simple antirotation plate 63 shown in FIG. 7.

The foregoing description has been directed to particular embodiments of the invention in accordance with the requirements of the Patent Statutes for the purposes of illustration and explanation. It will be apparent, however, to those skilled in this art that many modifications and changes in the device set forth will be possible without departing from the scope and spirit of the invention. It is intended that the following claims be interpreted to embrace all such modifications and changes.

What is claimed is:

1. For use with a door closing shut adjacent a door jamb, the door jamb including a dead bolt receiving striker plate and the door supporting a door locking dead bolt means having an interiorally exposed key operated lock and an interiorally exposed key operated lock and interiorally exposed thumb knob with a locking surface thereon wherein the locking surface rotates between first and second positions indicative of dead bolt movement between locked and unlocked positions relative to the striker plate on the door jamb, an interiorally located door locking apparatus comprising:

(a) support means mountable on the interior surface of the door;

(b) dead bolt slide means slidable between first and second positions, said slide means supported by said support means for sliding movement;

(c) elongated locking means cooperative with the thumb knob locking surface to lock the thumb knob at a rotated position after dead bolt insertion into the striker plate;

(d) cooperative striker plate means aligned with said dead bolt slide means to receive said dead bolt slide means on movement to the second position thereof and wherein said elongate locking means is held to lock the thumb knob, said cooperative striker plate means being mountable on the door jamb at a location to cooperate with said dead bolt slide means in holding the thumb knob in the locked rotated position; and (e) auxiliary locking means for engaging said dead bolt slide means in a locking relationship to prevent movement between the first and second positions.

2. The apparatus of claim 1 wherein said support means comprises an elongate sleeve having an elongate passage therethrough, said passage having a cross sectional shape to receive and hold said dead bolt slide means aligned to engage and disengage the thumb knob with said elongate locking means without rotation of said dead bolt slide means.

3. The apparatus of claim 1 wherein said support means has an elongate passage therethrough extending horizontally, said passage being rectangular in cross sectional shape, and wherein said dead bolt slide means has a rectangular cross section along the length thereof sized to fit within the passage within said support means to enable sliding movement horizontally between the first and second positions.

4. The structure of the apparatus of claim 3 wherein said dead bolt slide means incorporates a pair of spaced fingers defining a slot therebetween, said fingers and slot cooperatively forming said elongate locking means adapted to extend adjacent to and in locking relationship on two sides of the thumb knob to lock the thumb knob at a rotated position, thereby securing the thumb knob locking surface in the rotated position.

5. The apparatus of claim 4 wherein said elongate fingers and slot therebetween are open at one end and closed at the opposite end to engage by sliding motion the locking surface of the thumb knob, and wherein the fingers bracket the thumb knob on closing movement to the second position.

6. The apparatus of claim 5 wherein said cooperative striker plate means is formed with a pair of spaced openings therein sized and located to receive the tips of said pair of spaced fingers on horizontal sliding movement insertion thereinto, said striker plate means extending outwardly in planar fashion from the door jamb on mounting thereagainst.

7. The apparatus of claim 5 wherein said dead bolt slide means is formed with lock receiving means for receiving said auxiliary locking means.

8. The apparatus of claim 7 wherein said auxiliary lock means is independently keyed and operated independently of the dead bolt lock in the door.

9. The structure of claim 6 including a protruding hand grip extending from said dead bolt slide means.

10. The apparatus of claim 9 including a recessed area in said support means for receiving said protruding handle.

11. The apparatus of claim 6 wherein said auxiliary lock means comprises lock pin means for securing said elongate fingers in a fixed location relative to said striker plate means.

* * * * *